United States Patent [19]

Rezanka

[11] 4,127,327

[45] Nov. 28, 1978

[54] APPARATUSES INCORPORATING A COMPOSITE SUPPORT MEMBER

[75] Inventor: Ivan Rezanka, Pittsford, N.Y.

[73] Assignee: Xerox Corporation, Stamford, Conn.

[21] Appl. No.: 807,998

[22] Filed: Jun. 20, 1977

[51] Int. Cl.[2] ..... G03G 21/00

[52] U.S. Cl. ..... 355/15

[58] Field of Search ..... 118/621, 623, 636, DIG. 24; 355/15

[56] References Cited

U.S. PATENT DOCUMENTS

| | | | |
|---|---|---|---|
| 2,820,716 | 1/1958 | Harmon et al. | 118/636 X |
| 3,580,673 | 5/1971 | Yang | 355/15 |
| 3,893,815 | 7/1975 | Drummond, Jr. | 29/132 |

*Primary Examiner*—William M. Shoop
*Attorney, Agent, or Firm*—Earl T. Reichert

[57] ABSTRACT

A magnetic support member, and apparatuses including the support member for magnetic cleaning or magnetic development in an electrostatographic reproducing machine. The magnetic support member is formed of a composite composed of elongated bodies of a magnetic material having a high magnetic permeability in a non-magnetic matrix. The magnetic support member includes a support surface and the elongated bodies are aligned with respect thereto such that the direction of their long dimension is generally perpendicular within about ± 30° to the support surface or to a tangent to the support surface.

32 Claims, 8 Drawing Figures

APPARATUSES INCORPORATING A COMPOSITE SUPPORT MEMBER

CROSS REFERENCE TO A RELATED APPLICATION

U.S. application Ser. No. 737,303 filed Nov. 1, 1976, to I. Rezanka for a cleaning apparatus and electrostatographic reproducing machine.

BACKGROUND OF THE INVENTION

This invention relates to a support member, apparatuses incorporating the support member for magnetic cleaning or magnetic development, and an electrostatographic reproducing machine employing such apparatuses. The support member is formed of a composite composed of elongated bodies of a magnetic material having a high magnetic permeability in a non-magnetic matrix.

PRIOR ART STATEMENT

Magnetic transport apparatuses are employed in electrostatographic machines for a variety of purposes including developing and cleaning. For example, U.S. Pat. No. 3,246,629 to Shelffo, et al., and U.S. Pat. No. 3,915,121 to Wilcox are illustrative of the prior art with respect to the use of such transports for magnetic brush development. In these devices a non-magnetic cylindrical shell is arranged for rotation adjacent an imaging surface. Magnets are arranged within the shell so that their magnetic fields form a brush of developer material about the surface of the shell for application to the imaging surface to develop an electrostatic image thereon. The Shelffo patent is particularly relevant insofar as it also shows the use of composite coatings on the development roll shell to provide a roughened surface to aid in the development process.

U.S. Pat. No. 3,893,815 to Drummond shows an alternative magnetic roll structure wherein the roll shell is formed of a composite comprising a metal binder component and a particulate second phase component. The second phase component is selected to have a greater abrasion resistance than the metal binder and a portion of the second phase component protrudes from the metal binder at the support surface.

U.S. application Ser. No. 410,835, filed Oct. 29, 1973, to Drummond shows a magnetic roll shell formed of a composite comprising a non-metallic material, for example, a plastic, impregnated with small chip-like pieces of a relatively hard material designed to provide a desired surface roughness. This application also discloses the inclusion of a third component which comprises an electrically conductive filler material to promote electrical conductivity of the sleeve if desired.

The use of magnetic toner particles for developing electrostatic images is well known in the art. For example, U.S. Pat. No. 2,846,333 to Wilson teaches the use of a single component magnetic developer material which is applied directly to a photoconductive surface for development. U.S. Pat. No. 3,909,258 to Kotz also discloses the use of a single component developer for developing electrostatic images. The magnetic toner particles may be conductive or non-conductive.

Various reverse development approaches to cleaning are known including the use of magnetic brush cleaning as exemplified in the following U.S. Pat. Nos. 2,956,487 to Giamo, and 3,580,673 to Yang.

It is particularly desirable when utilizing magnetic developer particles to enhance the cleaning of the particles from the imaging surface by utilizing their magnetic properties. Of particular interest with respect to such an approach is U.S. Pat. No. 3,659,311 to Warren which discloses a device for scavenging magnetizable powder from a drum in a printing apparatus. The powder is attracted from the drum to the surface of a non-magnetic tube positioned parallel to the drum. A rotatable set of adjacent magnets is contained within the tube. The rotation of the magnets causes a divergent magnetic flux field to attract the magnetizable powder and to work the powder around the surface of the tube so that it may fall into a collection trough.

Conventional imaging surface cleaning devices known in the art comprise brushes, webs, rollers, blades, etc., as exemplified by the following U.S. Pat. No. 3,655,373 to Fisher; 3,510,903 to Stoever, et al.; 3,807,853 to Hudson; and 3,634,077 to Sullivan. In each of these systems devices are provided for removing the toner particles from the cleaning brush, etc. Sullivan shows the use of a biased pick-off roll for collecting and transporting toner particles removed by a blade cleaner. Fisher shows a biased pick-off roll for removing particles from a brush cleaner. Stoever and Hudson show the use of reduced pressure or vacuum for removing toner particles from a web or foam roll cleaner, respectively.

SUMMARY OF THE INVENTION

While it is known to employ magnetizable or magnetic toner particles for developing electrostatic images in an electrostatic reproducing machine, the fullest advantage has not been taken of the magnetizable nature of the particles to aid in their removal from the imaging surface or from a cleaning device used for such removal.

In the standard configurations of the magnetic roll cleaners or magnetic brush development apparatuses described above a permanently magnetized core is placed inside a non-magnetic shell, and either the magnetized core or the shell or both rotate. In practical cases the distance between the magnet and the imaging surfaces are on the order of 0.1 inches. It can be shown that over such a distance the magnetic detachment forces acting on a magnetic toner particle positioned at the imaging surface are very low.

On the other hand when toner poles are present on the shell of the developer roll or cleaning roll, for example, poles formed by the magnetic toner particles aggregating into bristles in a brush-like configuration, good cleaning or development can be obtained. Although part of the cleaning action is mechanical, it is believed that the magnetic bristles disturb the original field thereby increasing its inhomogenity and the magnetic detachment forces in their proximity. In comparison to the distance between the internal magnet pole and the imaging surface, the distance between the external roll surface and imaging surface can be maintained quite small, typically 0.01 inches.

In accordance with this invention a magnetic support member having a surface adapted to support or receive magnetic particles is provided. The support member is useful in apparatuses for cleaning or developing an imaging surface and for removing magnetic particles from imaging surface cleaning devices. The magnetic support member in accordance with this invention is formed of a composite material comprising a non-magnetic matrix having a plurality of elongated bodies of magnetic material distributed therein. The magnetic bodies have a high magnetic permeability. The support member has a desired thickness defined between a first support surface and a second surface extending generally parallel to one another. The magnetic bodies are arranged within the thickness of the support member with their long dimensions aligned generally perpendicular to the first support surface or to a tangent to that surface where the surface is arcuate. The lengths of the magnetic bodies should be much larger than their transverse dimensions in order to reduce de-magnetization effects. Preferably the lengths are 10 or more times the transverse dimensions.

The cleaning or development apparatuses employing the support member of this invention utilize it in a manner wherein it is immersed in a strong magnetic field such as can be provided by a conventional bar-type magnet. The elongated magnetic bodies provide a means for concentrating the field in the vicinity of their tips when they are aligned parallel to the lines of force.

Accordingly, it is an object of this invention to provide an improved support member for supporting or receiving magnetic particles. It is a further object of this invention to provide an improved magnetic roll cleaning or a magnetic roll development apparatus using the above support member.

It is a further object of this invention to provide an improved electrostatographic reproducing apparatus including a magnetic roll cleaning or development apparatus.

These and other objects will become more apparent from the following description and drawings.

DETAILED DESCRIPTION OF THE PREFERRED EMBODIMENTS

Figure 1:
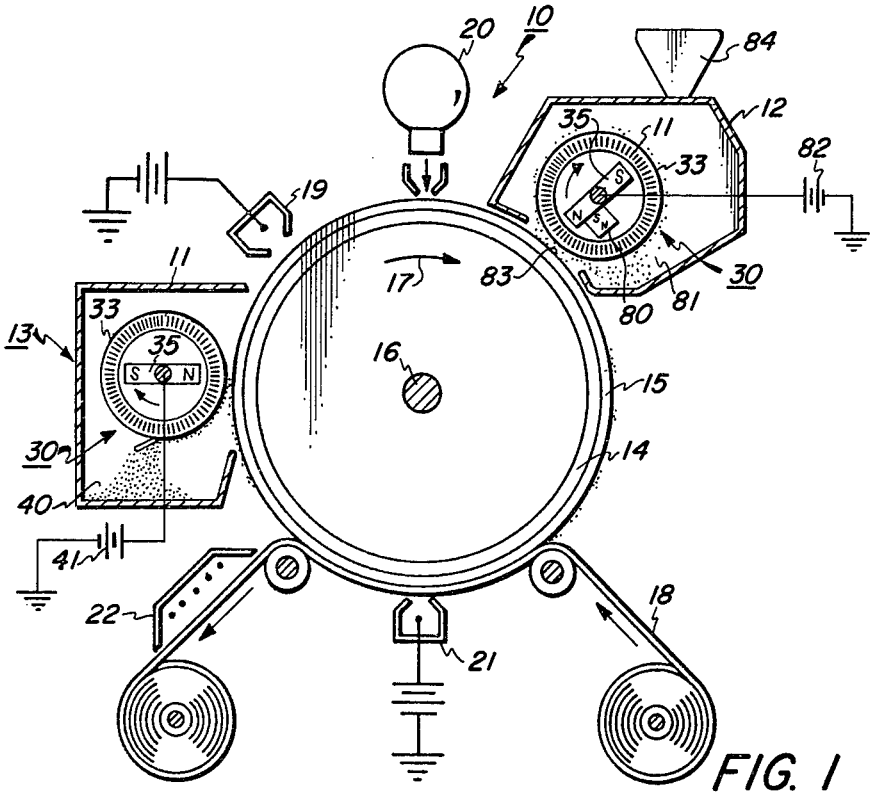
FIG. 1 is a schematic representation of an electrostatographic reproducing apparatus in accordance with this invention.

Referring now to FIG. 1 there is shown by way of example an automatic xerographic reproducing machine 10 which incorporates a magnetic brush support member 11; magnetic brush development apparatus 12; and magnetic brush cleaning apparatus 13 of the present invention. The reproducing machine 10 depicted in FIG. 1 illustrates the various components utilized therein for producing copies from an original. Although the magnetic support member 11, the magnetic development and cleaning apparatuses 12 and 13 of the present invention are particularly well adapted for use in an automatic xerographic reproducing machine, it should become evident from the following description that they are equally well suited for use in a wide variety of processing systems including other electrostatographic systems and they are not necessarily limited in their application to the particular embodiment or embodiments shown herein.

The reproducing machine illustrated in FIG. 1 employs an image recording drum-like member 14, the outer periphery of which is covered with a suitable photoconductive material 15. One type of suitable photoconductive material is disclosed in U.S. Pat. No. 2,970,906 issued to Bixby in 1961. The drum is suitably journaled for rotation within a machine frame (not shown) by means of a shaft 16 and rotates in the direction indicated by arrow 17 to bring the image retaining surface 15 thereon past a plurality of xerographic processing stations. Suitable drive means are provided to power and coordinate the motion of the various cooperating machine components whereby a faithful reproduction of the original input scene information is recorded upon a sheet or web 18 of final support material such as paper or the like.

The practice of xerography is well known in the art and is the subject of numerous patents and texts including *Xerography* by Dessauer & Clark, and *Electrophotography* by Schaffert, both published in 1965 by the Focal Press.

Initially the drum moves the photoconductive surface 15 through a charging station 19. In the charging station 19 an electrostatic charge is placed uniformly over the photoconductive surface 15 preparatory to imaging. The charging may be provided by a corona generating device of the type described in U.S. Pat. No. 2,836,725, issued to Vyverberg in 1958.

Thereafter the drum is rotated to exposure station 20 wherein the charged photoconductive surface 15 is exposed to a light image of the original input scene information whereby the charge is selectively dissipated in the light exposed regions to record the original input scene in the form of a latent electrostatic image. A suitable exposure system may be of the type described in U.S. Pat. No. 3,062,110, issued to Shepardson, et al. in 1962.

After exposure drum 14 rotates the electrostatic image recorded on the photoconductive surface 15 to development station 12 in accordance with this invention. Development station 12 includes a supply of single component magnetic developer material for rendering the latent image visible as a toner defined image. Preferably, developer unit 12 is a magnetic brush development system as in the above-noted Wilson or Kotz patents. In such a system, the single component magnetic developer material is brought through a directional flux field forming a brush thereof. The brush of magnetic developer material contacts the surface 15. The latent image attracts electrostatically the single component magnetic developer material from the system 12.

Alternatively, a multi-component developer mix can be applied to the photoconductive surface 15 of the drum to render the latent image visible. A suitable development station using a multi-component developer is disclosed in U.S. Pat. No. 3,707,947, issued to Reichart in 1973. This patent describes a magnetic brush development system utilizing a magnetizable developer mix having ferromagnetic carrier granules and toner colorant particles. The developer mix is brought through a directional flux field to form a brush thereof. The electrostatic latent image recorded on the photoconductive surface 15 is developed by bringing the brush of developer mix into contact therewith.

Further details of the development station 12 will be described later by specific reference to the present invention.

The developed image on the photoconductive surface 15 is then brought into contact with a sheet or web 18 of final support material within a transfer station 21 and the toner image is transferred from the photoconductive surface to the contacting side of the final support sheet. The final support material may be paper, plastic, etc., as desired.

After the toner image has been transferred to the sheet of final support material 18, the sheet with the image thereon is advanced to a suitable fuser 22 which coalesces the transferred powder image thereto. One type of suitable fuser is described in U.S. Pat. No. 2,701,765, issued to Codichini, et al. in 1955.

Although a preponderance of the toner powder is transferred to the final support material, invariably some residual toner remains on the photoconductive surface 15 after the transfer of the toner powder image to the final support material. The residual toner powder particles remaining on the photoconductive surface 15 after the transfer operation are removed therefrom as it moves through a cleaning station 13 of this invention. The toner particles may be cleaned from the photoconductive surface 15 by a magnetic roll 30 in accordance with this invention or by any conventional cleaning means such as a brush, blade, web, roller, etc., as described above which in turn is cleaned by a magnetic support in accordance with this invention.

It is believed that the foregoing description is sufficient for purposes of the present invention to illustrate the general operation of an automatic xerographic copier 10 which can embody the magnetic brush support member 11; the magnetic cleaning 13, and/or the magnetic developing 12 apparatuses in accordance with the present invention.

Figure 2:
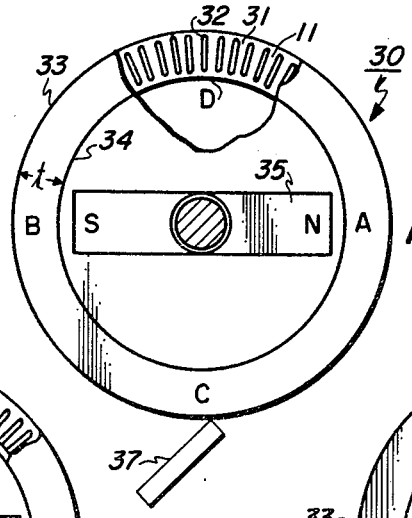
FIG. 2 shows a side view in partial cross-section of a magnetic roll apparatus in accordance with one embodiment of the invention.

The magnetic rolls 30 in accordance with one embodiment of the present invention are illustrated in FIGS. 1 and 2. The roll 30 comprises a magnetic support member 11 in accordance with this invention which is arranged for movement closely adjacent to the imaging surface 15. In the embodiment shown the magnetic support member comprises a cylindrical roll or sleeve which is arranged for movement preferably in a direction opposite to the direction of movement of the imaging surface. If desired, it could be arranged to rotate in the same direction as the surface 15. Multiple rolls could be employed, if desired. The sleeve 11 may have any desired cross-section including non-arcuate shapes or combinations of arcuate and non-arcuate shapes. Alternatively, the sleeve could comprise a web or belt.

The magnetic support sleeve 11 of this invention is formed of a composite comprising a non-magnetic matrix 31 having a plurality of elongated bodies 32 of magnetic material having a high magnetic permeability distributed therein. The thickness "*t*" of the sleeve is defined between the outer support surface 33 and the inner surface 34. The inner 34 and outer 33 surfaces comprise parallel or concentric surfaces. The elongated bodies 32 are arranged within the thickness "*t*" of the support member 11 so that their long direction is aligned generally perpendicular to a tangent to the support surface or in other terms they are aligned generally radially of the axis of the sleeve.

The magnetic bodies preferably have a length to width ratio of at least about 10:1. The width of the bodies 32 or their diameter for cylindrical ones preferably is at least about ½ the thickness of the gap defined from the support surface 33 to the imaging surface 15 up to less than about four times the thickness of that gap.

Preferably the magnetic bodies are distributed in the matrix so that they do no touch one another. Most preferably they should not be closer to one another than the width or diameter of a given body.

The magnetic bodies should have very high magnetic permeability, for example, preferably a magnetic permeability of at least about 10. The saturation magnetization of the body should preferably be higher than about 100 gauss CGS. Suitable materials for the magnetic bodies could comprise soft iron, silicon iron, and various other high permeability magnetic materials as are known in the art including ferrites and the like.

The non-magnetic matrix may be formed of any desired non-magnetic material including non-magnetic metals, plastics, glass, rubber, or ceramics. Plastics are preferred because it is easier to fabricate the composite sleeve 11 in accordance with the invention with a plastic matrix. If desired, the conductivity of a plastic matrix can be enhanced by adding conductive filler materials such as carbon, graphite, or metals such as aluminum or copper.

The magnetic bodies 32 in accordance with the present invention therefore have high magnetic permeability, high saturation, and low coercive force. The elongated magnetic bodies 32 provide a means for concentrating the field in the vicinity of their tips when they are immersed in a generally homogenous strong magnetic field with the lines of force aligned generally parallel to the long direction of the bodies.

The magnetic roll 30 includes a stationary permanent bar magnet 35 arranged internally of the support shell 11. The bar magnet 35 causes the magnetic bodies at the region of cleaning A or development to be immersed in a strong, but originally relatively homogenious field. A bar magnet 35 is shown, however, any desired magnet configuration providing such a field could be employed, including multi-pole cylindrical permanent magnets 36 as in FIG. 3. If desired, an electromagnet could be employed instead of a permanent magnet.

As the roll shell 11 rotates while the magnet 35 is held stationary, the magnetic detachment forces acting on the magnetic toner particles are especially enhanced in the zones A and B adjacent the poles of the magnet, namely, the zones wherein the lines of force of the magnet 35 or field direction extend generally radially sometimes described as a radial magnetic field. On the other hand in the zones C and D wherein the lines of force extend tangentially and the direction of the original field is, therefore, nearly perpendicular to the elongated direction of the magnetic bodies, the demagnetization of the magnetic bodies is severe, especially when they are of a nearly cylindrical shape. Therefore, such zones with tangential magnetic fields are suitable for removing the toner particles from the surface of the support member 11 as by the use of a doctoring or cleaning blade 37. It is preferred in accordance with this invention to provide a resilient blade 37 for removing the toner particles from the transport surface at a zone C of the surface wherein the magnetic adhesion forces holding the particles to that surface are expected to be the lowest, namely, zones wherein the magnetic field direction is transverse to the long dimension of the bodies.

Figure 4:
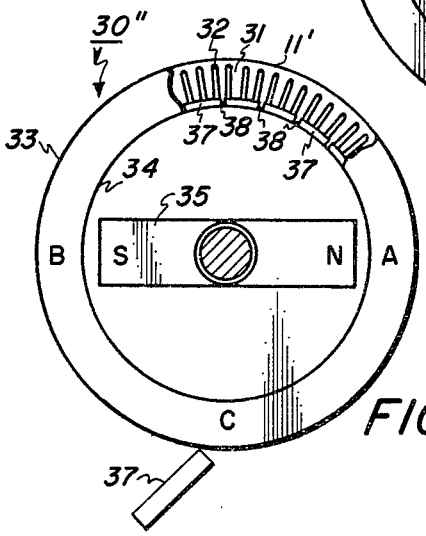
FIG. 4 shows a side view in partial cross-section of magnetic roll apparatus in accordance with yet another embodiment of the invention.
Figure 3:
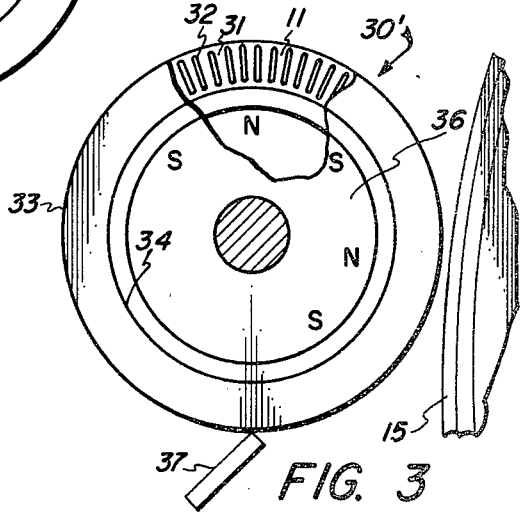
FIG. 3 shows a side view in partial cross-section of a magnetic roll apparatus in accordance with another embodiment of this invention.
Figure 5:
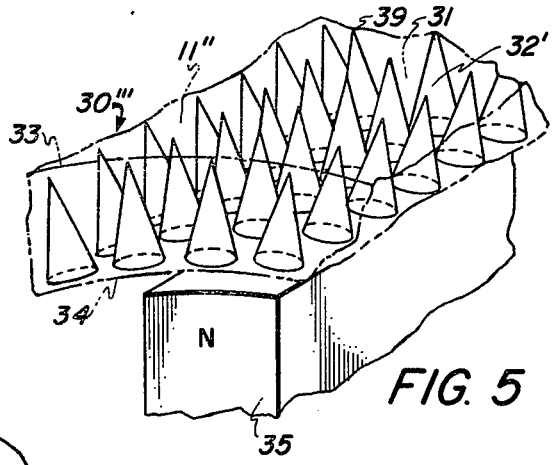
FIG. 5 shows a perspective view in partial cross-section of a magnetic roll apparatus in accordance with yet another embodiment of this invention.

Several modifications of the magnetic roll arrangement 30 of the present invention are apparent from consideration of FIGS. 3, 4, and 5. In FIG. 3 a roll 30' is provided with a multi-pole cylindrical magnet 36 substituted for the bar magnet 35 in the roll 30 of FIGS. 1 and 2. In this apparatus the detachment or adhesion magnetic forces are greatest in the zones adjacent the magnetic poles. These forces are lowest in the zone of blade 37.

Referring to FIG. 4, the degree of field concentration can be increased by adding on the inside of the shell 11 circumferentially spaced apart strips of high permeability magnetic material extending along the direction of the roll axis and separated azimuthally or circumferentially by voids 38 of non-magnetic material. The internal ends of the elongated bodies are connected to these strips. This configuration should concentrate preferentially the originally radial magnetic fields in the bodies 32 and cause high field gradiants close to their outer tips. The use of the magnetic strips 37 with the predetermined spacings 38 between them will not prohibitively shunt the magnetic field in the azimuthal direction.

Referring to FIG. 5 yet another roll embodiment 30''' is shown. In this embodiment the elongated bodies 32' are shaped as cones rather than being cylindrical. It is believed that elongated magnetic bodies 32' having the conical shape shown in FIG. 5 would provide a higher field gradiant at their vortices 39.

In each of the embodiments of the composite shell 11, 11' or 11'' described above, it it preferred that the ends of the bodies adjacent the support surface 33 lie in the support surface or as close thereto as reasonably possible.

Having thus described magnetic roll apparatus 30, 30',30'', or 30''' having transport shell members 11, 11', or 11'' in accordance with the present invention, their application in a magnetic cleaning apparatus 13 or in a magnetic developer apparatus 12 will now be described.

Referring again to FIGS. 1 and 2 a magnetic roll apparatus 30 of this invention is arranged in a cleaning apparatus 13. The shell 11 is arranged as close as possible to the imaging surface 15 though preferably it is spaced therefrom to define a narrow gap of less than about 0.02 inches and most preferably less than about 0.01 inches. The shell 11 is arranged for rotation in the direction of the arrow.

A bar type permanent magnet 35 is held stationary internally of the magnet in a conventional fashion with its north pole facing the imaging surface 15. This creates the desired radial field in a direction generally parallel to the elongated direction of the bodies 32 so that high magnetic detachment forces are generated in zone A adjacent the imaging surface 15. A blade 37 engages the shell 11 at a zone C with lower detachment forces and removes any magnetic toner particles from the roll surface 33 so that they drop into the collection sump 40.

The toner particles in the sump are periodically removed and may be reused in the development system if desired. Alternatively, automatic recirculation of the toner particles to the development means can be provided by any desired means, as for example, that described in U.S. Pat. No. 3,752,576 to Gerbasi.

The cleaning apparatus 12 of this invention is most preferred for use in removing magnetic toner particles without using carrier particles. However, the magnetic roll apparatus 30, etc., can be employed in place of a conventional roll in a magnetic brush cleaning apparatus such as that described in the above-identified patent to Yang which employs magnetic carrier particles for removing toner particles. The composite shells 11, etc., of this invention provide improved control of the bristle sites of the magnetic brush which is formed in such an apparatus thereby reducing the effects of dynamics on the seating and seeding of the bristles.

If desired, the shell 11, etc., can be made sufficiently conductive by using a conductive matrix 31 or by adding conductive fillers so that it can be biased in a conventional manner by a suitable source 41 to provide electrostatic forces to enhance toner detachment from the imaging surface.

The magnetic rolls of this invention are also useful as toner pick-off devices associated with conventional electrostatic cleaning systems as, for example, in the systems described in the above patents to Fisher, Stoever, et al., Hudson, and Sullivan patents.

Figure 6:
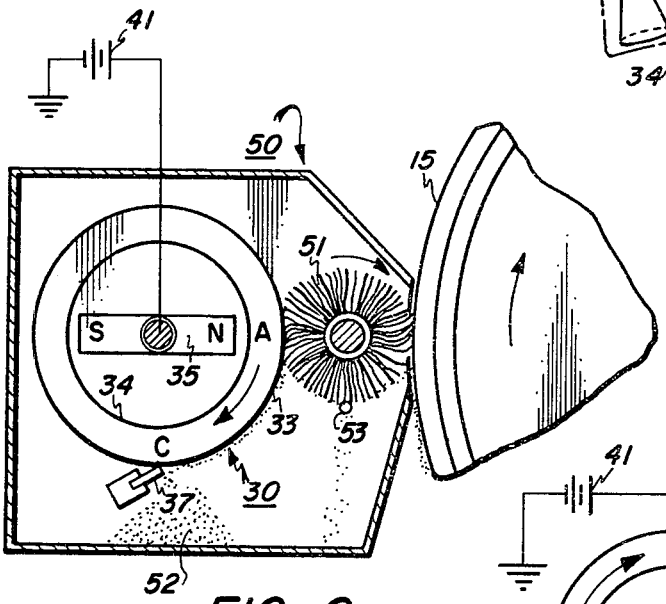
FIG. 6 is a schematic view showing a magnetic roll apparatus of this invention used in conjunction with a brush cleaner.

Referring now to FIG. 6, a conventional brush cleaning system 50 is shown wherein a magnetic roll 30 in accordance with the present invention is utilized to remove toner particles from the brush 51. The brush cleaner 50 is comprised of a rotating brush 51 which sweeps across the imaging surface 15 to remove any residual toner particles therefrom. The toner particles adhering to the brush fibers are removed by means of a magnetic roll apparatus 30 and blade 37, and drop into collection sump 52. A flicker bar 53 is also utilized to remove toner particles prior to the magnetic roll apparatus 30. The magnetic field is provided by a bar magnet 35 such that the zone A of high detachment forces is arranged adjacent to the brush 51. The blade 37 which removes the toner particles from the roll surface 33 is arranged at a zone C of low detachment forces.

This apparatus is advantageous as compared to a conventional brush cleaning apparatus since it is not essential to employ a reduced pressure or vacuum system for removing the toner particles from the brush. However, if desired, a reduced pressure can be provided. The magnetic roll apparatus 30 in accordance with this embodiment can be utilized in a toner reclaim system analogous to the one shown in the apparatus described in U.S. Pat. No. 3,955,235 to Meyer which utilizes an electrostatic pick-off roll for that purpose.

Figure 7:
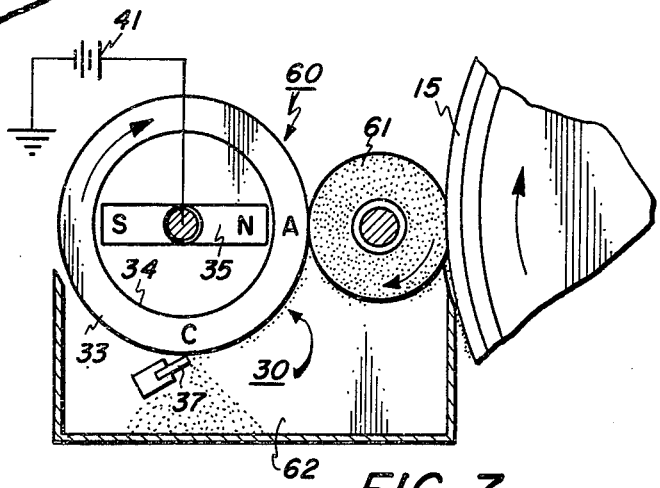
FIG. 7 is a schematic view showing a magnetic roll apparatus of this invention used in conjunction with a roll type cleaner.

FIG. 7 shows a foam roll cleaner 60 for removing the toner particles from the imaging surface 15. The toner particles removed by the polyurethane foam roll 61 are themselves removed by means of an engaging magnetic roll apparatus 30 in accordance with this invention arranged in a similar manner to that described by reference to FIG. 6. The particles are collected in sump 62.

Figure 8:
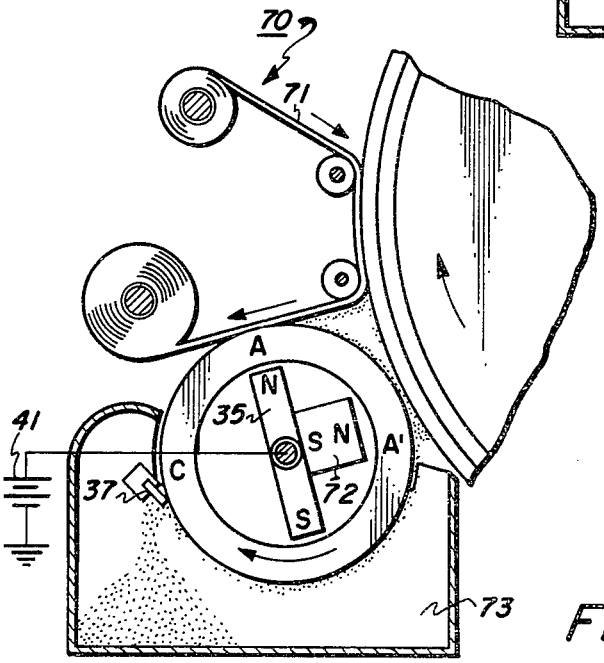
FIG. 8 is a schematic view showing a magnetic roll apparatus in accordance with this invention used in conjunction with a web-type cleaner.

FIG. 8 shows a web cleaning apparatus 70 for removing the toner particles from the imaging surface 15. The magnetic roll apparatus 30 of the present invention is arranged to provide a dual function. It sweeps in engagement with the cleaning web 71 for removing toner particles therefrom in the same manner as the apparatuses of FIGS. 6 and 7. It is also arranged closely adjacent to the imaging surface 15 so that it is operative on the imaging surface for direct removal of toner particles by magnetic attraction. In order to provide the desired radial magnetic field to obtain high attractive forces in the region A adjacent the web 71 and in the region A' adjacent the imaging surface 15, an additional magnet 72 is provided having a pole facing the imaging surface. The toner particles removed by the magnetic roll apparatus 30 are in turn scraped from the roll surface by means of a doctor blade 37 and may be stored in a sump 73. Alternatively, a multipole magnet 36 as in FIG. 3 could be employed in this embodiment in place of magnets 35 and 72.

If desired the magnetic rolls 30 in the apparatuses of FIGS. 6 - 8 can be electrically biased by means 41 to provide an electrostatic assist to the cleaning action of the roll.

Referring again to FIG. 1, a magnetic roll apparatus 30 is arranged in a developing apparatus 12 of this invention. The magnetic roll apparatus 30 shown therein is similar in most respects to that described by reference to FIG. 2, however, an additional permanent magnet 80 is included to provide a pick-up magnetic field. The roll 30 is immersed in a sump of magnetic developer particles (not shown). The field associated with the pick-up magnet attracts the particles to the roll surface 33 in a brush-like configuration. The roll 30 is spaced from the imaging surface 15 so that the brush may be brought in sweeping engagement against that surface in order to deposit the particles in accordance with latent electrostatic image thereon.

In a preferred embodiment the roll is conductive and the magnetic toner particles are conductive so that they can be biased by means 82 at a potential opposite to that of the latent image on the photoconductive surface 15. The electrostatic attraction between the toner particles and the latent electrostatic image is greater than the magnetic attraction between the particles thereby providing for transfer of the particles from the brush of toner particles to the imaging surface. A radial field of the internal magnet is arranged adjacent the development zone. Additional toner particles may be added to the sump 81 from a suitable dispenser mechanism 84.

While the magnetic roll in the development system 12 has been described with reference to the use of single component developer in the manner of the Wilson and Kotz systems noted above, it is equally well suited for use in multi-component developer systems in the manner of Wilcox noted above. The shell 11 of this invention is particularly advantageous for magnetic brush apparatuses since it provides better control of the sites and seating of the bristles of the brush.

While the magnetic rolls 30 which have been described are preferred, if desired, the shell could be held stationary and the magnet rotated.

The composite shell 11 in accordance with the present invention may be formed by any desired conventional technique. Typically the elongated magnetic bodies 32 could comprise cut cylindrical wire particles.

A roll-type shell 11 could be formed, for example, in the following manner. A suitable mold would comprise two concentric cylinders. The wall of the outer cylinder would include a plurality of radial holes distributed in the manner in which the elongated bodies 32 are to be provided in the resulting shell 11. Soft iron wires for forming the elongated bodies are inserted through the radially distributed holes in the outer cylinder wall until they touch the inner cylinder. In this manner the wires forming the bodies would be held in the desired orientation and pattern.

A suitable epoxy type potting compound as are known in the art, which is curable at room temperature, is then poured into the mold defined by the space between the cylinders and allowed to set and become rigid. After the epoxy has set, the cylindrical shell 11 formed thereby is pushed out of the mold thereby shearing off the magnetic bodies 37 embedded in the shell 11 from the wires positioned in the outer cylinder. The outer support surface 33 of the shell can then be machined to a desired finish. This approach to fabricating the shell 11 in accordance with the present invention is set forth by way of example only, and any desired means for fabricating such a shell could be employed.

The term "generally perpendicular" as used in this application is defined herein to onclude a range of orientations of the bodies within about ± 30° of perpendicular. The preferred range of orientations of the bodies with respect to the support surface is within about ± 15° of perpendicular.

The patents and texts referred to specifically in detailed description of this application are intended to be incorporated by reference into the description.

It is apparent that there has been provided in accordance with this invention apparatuses incorporating a composite support member which fully satisfies the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A magnetic support member for supporting magnetic particles in an electrostatographic reproducing machine, said support member being formed of a composite comprising a plurality of elongated bodies formed of a magnetic material having a high magnetic permeability distributed in a matrix formed of a nonmagnetic material, said support member including a support surface and said elongated bodies being aligned with respect to said support surface such that the direction of their long dimension is generally perpendicular within about ± 30° to said support surface or to a tangent to said support surface.

2. A member as in claim 1, wherein said magnetic bodies comprise elongated cylinders.

3. A member as in claim 1, wherein said magnetic bodies have a conical shape with the vortices arranged at said support surface.

4. A member as in claim 1, wherein said support member comprises a hollow sleeve and said support surface comprises an endless surface.

5. A member as in claim 4, wherein said sleeve comprises a cylinder defining a cylindrical axis, and further including a plurality of axially extending strips of magnetic material having a high magnetic permeability arranged internally in said sleeve in association with said bodies, said strips being spaced apart asimuthally one from the other, whereby said bodies and said strips are adapted to preferentially concentrate an applied magnetic field in the bodies and to cause high field gradiants at said support surface in correspondence with said bodies.

6. A member as in claim 1, wherein the magnetic permeability of said bodies is at least about 10.

7. A magnetic transport apparatus for transporting magnetic particles in an electrostatographic reproducing machine comprising;

a magnetic support member for supporting said magnetic particles, said support member being formed of a composite comprising a plurality of elongated bodies formed of a magnetic material having a high magnetic permeability distributed in a matrix formed of a non-magnetic material, said support member including a support surface and said elongated bodies being aligned with respect to said support surface such that the direction of their long dimension is generally perpendicular within about ± 30° to said support surface or to a tangent to said support surface;

means associated with said support member for providing a strong magnetic field for attracting said magnetic particles to said support surface whereby said bodies provide a means for concentrating said magnetic field at their ends adjacent said support surface when said direction of the long dimension of said bodies is generally parallel to the direction of said magnetic field.

8. An apparatus as in claim 7, wherein said magnetic bodies comprise elongated cylinders.

9. An apparatus as in claim 7, wherein said magnetic bodies have a conical shape with the vortices arranged at said support surface.

10. An apparatus as in claim 7, wherein said support member comprises a hollow sleeve and said support surface comprises an endless surface.

11. An apparatus as in claim 10, wherein said sleeve comprises a cylinder defining a cylindrical axis, and further including a plurality of axially extending strips of magnetic material having a high magnetic permeability arranged internally in said sleeve in association with said bodies, said strips being spaced apart asimuthally one from the other, whereby said bodies and said strips are adapted to preferentially concentrate an applied magnetic field in the bodies and to cause high field gradiants at said support surface in correspondence with said bodies.

12. An apparatus as in claim 10, wherein the magnetic permeability of said bodies is at least about 10.

13. An apparatus as in claim 10, wherein said magnetic field providing means comprises a bar magnet.

14. An apparatus as in claim 10, wherein said magnetic field providing means comprises a multi-pole permanent magnet.

15. An apparatus as in claim 10, wherein said member is formed of a composite further including a conductive filler material.

16. An apparatus as in claim 7, further including an imaging surface and wherein said magnetic transport apparatus comprises a means for removing said magnetic particles from said imaging surface, and wherein said magnetic support member comprises a hollow sleeve and said support surface comprises an endless surface, and wherein said means for generating said magnetic field comprises means for providing a radial magnetic field between said imaging surface and said support surface for attracting said magnetic particles from said imaging surface to said support surface, said imaging surface and said support surface being arranged for relative movement.

17. An apparatus as in claim 7, further including an imaging surface and wherein said magnetic transport apparatus comprises a means for developing an electrostatic image on said imaging surface to render it visible, and wherein said magnetic support member comprises a hollow sleeve and said support surface comprises an endless surface, and wherein said means for generating said magnetic field comprises means for providing a radial magnetic field between said imaging surface and said support surface for forming a magnetic brush of said particles for sweeping across said imaging surface, said imaging surface and said support surface being arranged for relative movement.

18. In an electrostatographic reproducing machine including an imaging surface arranged for movement; means for forming an electrostatic image on said surface; means for developing said electrostatic image with magnetic toner particles to render it visible; means for transferring said developed image to a sheet of final support material; and means for cleaning said imaging surface of residual toner particles after said image transfer therefrom, said cleaning means including means for removing said residual toner particles from said imaging surface, the improvement wherein said cleaning means further includes means for receiving said toner particles from said removing means and for transporting said toner particles away therefrom, said receiving and transporting means comprising a magnetic transport member, said magnetic transport member being formed of a composite comprising a plurality of elongated bodies formed of a magnetic material having a high magnetic permeability distributed in a matrix formed of a non-magnetic material, said transport member including a support surface and said elongated bodies being aligned with respect to said support surface such that the direction of their long dimension is generally perpendicular within about ± 30° to said support surface, or to a tangent to said support surface;

and means for providing a strong magnetic field in association with said transport member for magnetically attracting said particles from said removing means to said transport member.

19. A machine as in claim 18, wherein said magnetic bodies comprise elongated cylinders.

20. A machine as in claim 18, wherein said magnetic bodies have a conical shape with the vortices arranged at said support surface.

21. A machine as in claim 18, wherein said transport member comprises a hollow sleeve and said support surface comprises an endless surface.

22. A machine as in claim 21, wherein said sleeve comprises a cylinder defining a cylindrical axis, and further including a plurality of axially extending strips of magnetic material having a high magnetic permeability arranged internally in said sleeve in association with said bodies, said strips being spaced apart asimuthally one from the other, whereby said bodies and said strips are adapted to preferentially concentrate an applied magnetic field in the bodies and to cause high field gradiants at said support surface in correspondence with said bodies.

23. A machine as in claim 18, wherein the magnetic permeability of said bodies is at least about 10.

24. A machine as in claim 18, wherein said magnetic field providing means comprises a bar magnet.

25. A machine as in claim 18, wherein said magnetic field providing means comprises a multi-pole permanent magnet.

26. A machine as in claim 18, wherein said member is formed of a composite further including a conductive filler material.

27. A machine as in claim 18, further including means for electrically biasing said support surface to assist in attracting said toner particles thereto.

28. A machine as in claim 18, said magnetic transport member is also arranged in close proximity to said imaging surface, and wherein said magnetic field providing means includes means for providing a radial magnetic field between said support surface and said means for removing said particles from said imaging surface and a radial magnetic field between said support surface and said imaging surface;

whereby said receiving and transporting means provides dual functions comprising removing said toner particles from said means for removing said toner particles and removing said toner particles directly from said imaging surface.

29. A machine as in claim 18, wherein said means for removing said toner particles comprises a brush.

30. A machine as in claim 18, wherein said means for removing said toner particles from said imaging surface comprises a roller.

31. A machine as in claim 18, wherein said means for removing said toner particles from said imaging surface comprises a web.

32. A machine as in claim 28, wherein said means for removing said toner particles from said imaging surface comprises a web.

* * * * *